US009824800B2

(12) United States Patent
Doser et al.

(10) Patent No.: US 9,824,800 B2
(45) Date of Patent: Nov. 21, 2017

(54) MULTI-TERMINAL SURGE ARRESTER

(71) Applicant: ABB Schweiz AG, Baden (CH)

(72) Inventors: Bernhard Doser, Waldshut-Tiengen (DE); Peter Dubach, Fislisbach (CH); Felix Greuter, Baden-Rutihof (CH); Elisabeth Lindell, Vasteras (SE); Lars Liljestrand, Västerås (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 14/945,918

(22) Filed: Nov. 19, 2015

(65) Prior Publication Data

US 2016/0148728 A1 May 26, 2016

(30) Foreign Application Priority Data

Nov. 21, 2014 (EP) ..... 14194288

(51) Int. Cl.
*H01C 7/10* (2006.01)
*H01C 7/12* (2006.01)
*H01C 1/02* (2006.01)

(52) U.S. Cl.
CPC ..... *H01C 7/12* (2013.01); *H01C 1/02* (2013.01)

(58) Field of Classification Search
CPC ..... H01C 7/123; H01C 7/112; H01C 7/10; H01C 7/13; H01C 7/12
USPC ..... 338/21, 13; 361/111, 112, 117
See application file for complete search history.

(56) References Cited

U.S. PATENT DOCUMENTS 4,212,047 A 7/1980 Napiorkowski
4,476,513 A 10/1984 Stenstrom
4,604,673 A 8/1986 Schoendube
4,962,440 A 10/1990 Johnnerfelt et al.
5,291,366 A * 3/1994 Giese ..... H01C 7/12 338/21
5,444,429 A * 8/1995 Sakich ..... H01C 7/12 338/21
5,570,264 A * 10/1996 Lundquist ..... H01C 7/123 361/117
5,602,710 A 2/1997 Schmidt et al.
5,680,289 A * 10/1997 Robinson ..... H01C 7/126 338/21
6,302,723 B1 10/2001 Baum et al.
(Continued)

FOREIGN PATENT DOCUMENTS

EP 0642141 A1 3/1995

*Primary Examiner* — Kyung Lee
(74) *Attorney, Agent, or Firm* — Whitmyer IP Group LLC

(57) ABSTRACT

A multi-terminal surge arrester which includes an active part extending along a longitudinal direction of the surge arrester, a first electrode resting against a first end of the active part, and a second electrode resting against a second end of the active part, which second end opposes the first end in the longitudinal direction of the surge arrester. The surge arrester further includes an insulating fixing device mechanically connecting and fixing the first electrode and the second electrode, and an insulating housing arranged around the active part. The active part includes at least two metal-oxide based varistor elements and a further electrode arranged between the at least two varistor elements, which further electrode provides an externally accessible electrical connection. Therein, the surge arrester is adapted for being insulated by surrounding air.

18 Claims, 8 Drawing Sheets

(56) References Cited

U.S. PATENT DOCUMENTS

| | | | | |
|---|---|---|---|---|
| 6,735,068 | B1 * | 5/2004 | Hartman | H01C 7/126<br>361/117 |
| 6,778,374 | B2 * | 8/2004 | Berlovan | H01C 7/126<br>361/111 |
| 7,586,729 | B2 * | 9/2009 | Gohler | H01C 7/126<br>361/127 |
| 8,154,839 | B2 * | 4/2012 | Stenstrom | H01C 7/123<br>338/21 |
| 2003/0128492 | A1 * | 7/2003 | Berlovan | H01C 7/126<br>361/118 |
| 2012/0293905 | A1 | 11/2012 | Gebhardt et al. | |

* cited by examiner

MULTI-TERMINAL SURGE ARRESTER

FIELD OF THE INVENTION

The present invention relates to the field of surge arresters. Particularly, the present invention relates to an air insulated multi-terminal surge arrester adapted for medium to high voltages. Further, the invention relates to an arrester arrangement comprising a plurality of such multi-terminal surge arresters.

BACKGROUND OF THE INVENTION

In order to protect electrical equipment, such as for instance transformers, against potentially damaging over-voltage transients, usually surge arresters are employed. Such over-voltage transients may be caused both by external events, such as e.g. by lightning, or by internal events, such as e.g. resonances in a transformer winding induced by switching a circuit breaker connected to the transformer.

For safety purposes, surge arresters usually comprise a number of varistor blocks providing a conduction path for diverting and/or bypassing over-voltage transients safely to ground in case a varistor-dependent threshold in voltage is exceeded.

Generally, surge arresters are known in various embodiments. For instance WO 2011/095590 A1 and US 2012/0293905 A1 relate to a surge arrester with an active part and two electrodes arranged in a connecting element produced in an injection molding or die-casting process.

EP 0 642 141 A1 and U.S. Pat. No. 5,602,710 disclose a surge arrester with a varistor block between two connection fittings, which are cast with insulating material to form a monolithic body.

U.S. Pat. No. 4,604,673 discloses a shell-type distribution transformer with surge protection device comprising a metal oxide varistor device. In order to insulate the varistor device, it is mounted within an oil-filled tank. The varistor device is connected between a high-voltage winding of the transformer and ground. A further connection is provided between a mid-point of the varistor device and a mid-point of the high-voltage winding to protect the high voltage winding against both voltage surges entering via its terminals as well as current surges entering via terminals of a low voltage winding of the transformer. A drawback of such an integrated protection means may be that the complete final component cannot be tested with respect to its safe dielectric function and reliability, as described e.g. by standards, since the metal oxide varistor device may limit the test voltages.

SUMMARY OF THE INVENTION

It is an object of the invention to provide a multi-terminal surge arrester, which is operated in and insulated by surrounding air, and which provides multiple externally accessible electrical connections and/or which simplifies a mounting of the surge arrester.

This object is achieved by the subject-matter of the independent claim. Further exemplary embodiments are evident from the dependent claims and the following description.

An aspect of the invention relates to a multi-terminal surge arrester. The surge arrester may particularly be adapted for protecting electrical equipment, such as e.g. a transformer, against medium to high over-voltage transients above approximately 1 kV.

The surge arrester comprises an active part extending along a longitudinal direction of the surge arrester, a first electrode resting against a first end of the active part, and a second electrode resting against a second end of the active part, which second end opposes the first end in the longitudinal direction of the surge arrester. The surge arrester further comprises an insulating fixing device mechanically connecting and fixing the first electrode and the second electrode, and an insulating housing arranged around the active part. The active part comprises at least two metal-oxide based varistor elements and a further electrode arranged between the at least two varistor elements, which further electrode provides an externally accessible electrical connection.

The insulating housing may also be arranged around the fixing device. The insulating housing may be integrally formed with the insulating fixing device, i.e. the insulating housing may be part of the fixing device, or the insulating housing may be formed as separate part of the surge arrester. Generally, the insulating housing may provide a comprehensive protect on layer for the surge arrester. The insulating housing may for example be molded, e.g. directly molded, around the active part and optionally around the fixing device, such that the active part may not be exposed to an environment, in particular such that water, humidity, dirt and/or similar substances with high electrical conductivity compared to the housing may not enter the surge arrester and/or come into contact with the active part. The housing may be in direct contact and/or directly adjoining at least a part of the fixing device and optionally the active part. The insulating housing may also be molded at least partly around the first and second electrodes. To avoid air inclusions and/or air entrapments as well as to ensure proper adhesion of the insulating housing at the active part, the fixing device, and/or the first and second electrodes, a layer of adhesion promoting material, such as e.g. an adhesion-promoting agent, a bonding agent and/or a primer, may be arranged between the insulating housing and the active part and/or the fixing device.

The surge arrester with the insulating housing may be adapted for being operated in air and not for instance in a container filled with dielectric, such as e.g. an oil-filled tank. In particular, the surge arrester may be adapted for being insulated by surrounding air, wherein the surrounding air may refer to a layer of air in direct contact with an outer surface of the surge arrester.

The further electrode may advantageously provide an electrical and/or thermal connection between the two metal oxide varistor elements, while further providing a mid-point electrical connection and/or an electrical tapping to the surge arrester, which electrical connection and/or an electrical tapping may easily be accessed from outside the surge arrester and electrically connected to an external component, such as e.g. an electrical line to a winding of the transformer. It is noted here that the term "mid-point electrical connection" may refer to an electrical connection and/or tapping arranged on an arbitrary position and/or location and/or in an arbitrary region between the first and second electrode along the longitudinal direction, i.e. the term may not be restricted to an electrical connection arranged in a geometrical middle of the surge arrester. Compared to for instance bolting two common surge arresters together to provide the further electrode, the inventive surge arrester may save production cost, mounting cost, and/or maintenance cost. Apart from this, via the further electrode the inventive surge arrester saves space as a more compact design and may easily and/or quickly be mounted and/or retrofit to already existing protection systems against over-voltage transients. As a consequence, the multi-terminal surge arrester may be economically competitive and attractive.

The active part of the surge arrester may be substantially cylindrically shaped. Accordingly, the longitudinal direction of the surge arrester may substantially be parallel to a longitudinal extension direction of the surge arrester's active part. Generally, the active part may particularly provide a conduction path between the first electrode and the second electrode in case a varistor-dependent threshold in voltage is reached and/or exceeded. The varistor elements may denote here and in the following varistor blocks manufactured from metal-oxide based material, such as e.g. ZnO based material. Such material may be highly electrically resistive up to a certain voltage level, above which the material turns into an electrically conducting state. The varistor elements may be e.g. cylindrically, cubically, box-like, or arbitrarily shaped. The varistor elements and the further electrode may for instance be stacked on top of each other in the longitudinal direction. Each varistor element may have a nominal voltage of at least 400 V, wherein the at least two varistor elements may have the same or different nominal voltage.

The first electrode, the second electrode, and the further electrode may refer to electrical terminals of the surge arrester providing an electrical tapping and/or an electrical connection to the surge arrester. Therein, particularly the further electrode provides an electrical connection and/or tapping, which may be accessed and/or contacted externally by connecting an electrically conductive element, such as e.g. a contact element, a cable, and/or an electrical line, to the further electrode. The further electrode may in this context refer to a mid-point connection of the surge arrester, which mid-point connection may be on an arbitrary potential ranging between a potential of the first electrode and the second electrode, respectively.

The insulating fixing device may mechanically connect and/or fix and/or clamp the first electrode and the second electrode. The fixing device of insulating material may denote an apparatus adapted for pressing the first and the second electrode towards and/or against the first and the second end of the active part, respectively. The fixing device may also be adapted for mechanically stabilizing the active part, particularly the at least two varistor elements and the further electrode arranged between the at least two varistor elements. The fixing device may mechanically stabilize the active part in the longitudinal direction and/or radially, i.e. in a direction orthogonal to the longitudinal direction. For this purpose, the fixing device may comprise at least one strap-like, rod-like, tape-like, ribbon-like, loop-like or any other appropriate elongated element, which may be arranged laterally on at least one side of the active part connecting the first and the second electrode, and/or which may at least partially encompass the active part. The fixing device may additionally or alternatively comprise a tube-like element, which may at least partially encompass and/or surround the active part for mechanical fixation. Moreover, the fixing device may comprise at least one appropriate attachment means, such as e.g. a screw, a bolt and/or a rivet for mechanically fixing the active part and/or the first and second electrodes.

According to an embodiment of the invention, the insulating housing comprises a solid insulation material and/or a solid state insulation material. In other words, the insulating housing may be manufactured from a solid and/or solid state material, such as e.g. silicone, an elastomer, a thermoplast, and/or a duromere. Further, the insulating housing may be injection-molded and/or casted and/or extruded. The insulating housing may e.g. be injection-molded and/or casted and/or extruded around the active part and the fixing device during production of the surge arrester.

The insulating silicone housing may provide a low-cost, durable, robust, comprehensive and reliable insulation and protection, e.g. against water, humidity and/or dirt. It may be stressed here, that such silicone housing may not be adapted for being exposed to a dielectric medium, such as oil, which is frequently used for insulation of transformers, because material characteristics of silicone may be affected and/or the silicone housing may be degraded in the dielectric medium. For instance, silicone may be perished when exposed to oil.

According to an embodiment of the invention, the active part further comprises at least one metal-spacer for dissipating and/or conducting heat. The metal-spacer may be manufactured from electrically conductive material, such as e.g. aluminum, Fe and/or an appropriate alloy. Generally, the metal-spacer may have a thickness smaller than a thickness of the further electrode of the surge arrester, wherein the thicknesses may refer to extensions in longitudinal direction, respectively. The metal-spacer may for instance be arranged between two varistor elements. The metal-spacer may particularly be adapted for spreading heat, which may be generated around the conduction path of over-voltage transients in the active part and/or the varistor elements, thereby locally reducing the heat and accordingly reducing a stress to the material. Further, the metal-spacer may be adapted for providing a proper electrical connection between two neighboring varistor elements adjoining the metal-spacer.

According to an embodiment of the invention, the further electrode comprises a hole adapted for providing a tapping region for electrical connection and/or a fixation region for mechanical fixation of the surge arrester. The hole may refer to a recess, opening, cavity, cut-out, notch, bore, and/or drill-hole, which may extend from an outer surface of the further electrode into the further electrode in arbitrary direction. Preferably, the hole extends orthogonal to the longitudinal direction of the surge arrester. The hole may have an arbitrary cross section, such as e.g. a round, an oval, an elliptic, a triangular, a rectangular, a quadratic, a polygon-like, or any other cross-section. Further, a cross-section and/or a circumference of the hole may not be constant along the extension of the hole. In other words, the hole may be tapered towards any end of the hole, for instance towards a middle region of the further electrode and/or towards an outer surface or periphery of the further electrode. Generally, the hole may be adapted for providing a reliable and robust electrical connection and/or a mechanical fixation of the surge arrester, e.g. on a component of the transformer. For example, an electrical line and/or a connector may be at least partially inserted into the hole and attached to the further electrode with an appropriate attachment and/or fixation means, such as a screw, a rivet, and/or a bolt. For this purpose, the hole may comprise a thread. The hole may be externally accessible, with or without using tools, through the insulating housing.

According to an embodiment of the invention, the further electrode comprises a protrusion extending orthogonal to the longitudinal direction of the surge arrester, wherein the protrusion is adapted for providing a tapping region for electrical connection and/or a fixation region for mechanical fixation. The protrusion may protrude nose-like from a body region of the further electrode, which may refer to a middle or center region of the further electrode, wherein the protrusion may be arbitrarily shaped, such as e.g. box-like, cylindrical, and/or trapezoidal. Further, the protrusion may be integrally formed with the further electrode or it may be formed as a separate part, which may be attached to the further electrode, e.g. by gluing, welding, soldering, and/or mechanically, e.g. with a screw, a bolt, and/or a rivet.

According to an embodiment of the invention, the further electrode extends through the insulating housing of the surge arrester, such that the further electrode is accessible from outside the housing. The further electrode may either protrude and/or extend entirely through the housing or it may be at least partially covered by the housing, such that for example a contact element may be pierced and/or jacked through the housing in order to electrically contact the further electrode.

According to a further embodiment of the invention, the further electrode comprises a hole extending from an outer surface of the further electrode at least partially into a protrusion of the further electrode. The hole may extend in arbitrary direction into the protrusion, preferably the hole may extend orthogonal to the longitudinal direction of the surge arrester into the protrusion. The protrusion may provide a tapping region for electrical connection and/or a fixation region for mechanical fixation of the surge arrester. For instance an electrical line and/or a cable may be at least partly inserted into the hole to electrically contact the further electrode. Further a fixing element, such as e.g. a screw, a bolt, and/or a rivet, may be at least partly inserted into the hole to mechanically fix and/or mount the surge arrester, wherein the hole may comprise a thread.

According to an embodiment of the invention, the hole extends from the outer surface of the further electrode entirely through the further electrode. In other words, the hole may entirely traverse the further electrode in arbitrary direction, preferably orthogonal to the longitudinal direction of the surge arrester. The hole may be adapted for electrically connecting the further electrode and/or for mechanical fixation of the surge arrester, such as e.g. for mounting the arrester on and/or attaching it to the transformer. For instance, an electrical connection may be established by connecting an electrical line to a first end of the hole, while the arrester may be attached to the transformer with a fixing element at least partly inserted into the hole at a second end of the hole opposing the first end.

According to an embodiment of the invention, the further electrode comprises two protrusions, both extending orthogonal to the longitudinal direction. The two protrusions may extend antiparallel with respect to each other from a body region of the further electrode, i.e. the two protrusions may be arranged on opposing sides of the further electrode. The protrusions may also be arranged at an arbitrary angle with respect to each other. For instance they may be arranged and/or extend orthogonally with respect to each other from the body region of the further electrode.

According to an embodiment of the invention, the further electrode has a thickness of at least 5 mm, for instance at least 7 mm and particularly at least 10 mm. The thickness may refer to an extension of the further electrode parallel to the longitudinal direction. This way, a mechanical robustness of the further electrode as well as of an electrical connection established to the further electrode and/or a mechanical fixation of the surge arrester using the further electrode may be increased and/or ensured.

According to a further embodiment of the invention, the surge arrester comprises a plurality of varistor elements and at least two further electrodes, wherein each of the at least two further electrodes is arranged between two varistor elements, which varistor elements each may be directly adjoining a side of at least one of the further electrodes. Each of the at least two further electrodes is adapted for providing an electrical connection, which may be externally accessible, wherein at least one of the at least two further electrodes is adapted for providing a mechanical fixation of the surge arrester in addition to the electrical connection. This way a compact surge arrester with a plurality of electric terminals and/or electrodes may be provided, which electrodes may e.g. be connected to multiple parts of a transformer, while the arrester may reliably be mounted to and/or mechanically fixed on the transformer using at least one of the further electrodes.

A further aspect of the invention relates to an arrester arrangement comprising a plurality of multi-terminal surge arresters as describes in the above and in the following. The surge arresters may be arranged in an arbitrary pattern with respect to each other, such as for instance in a single or multiple rows, in a triangular geometry, in a circular geometry, in a semicircular geometry, in a rectangular, or in an arched geometry.

According to an embodiment of the invention, three surge arresters are arranged in juxtaposition in a row and/or in a triangular geometry. In other words, the arrester arrangement may comprise three surge arresters, which may be arranged next to each other in a row and/or a triangular geometry, wherein each of the surge arresters may be adapted for protection against over-voltage transients in a single phase of a three-phase alternating current system, e.g. a three-phase transformer.

According to an embodiment of the invention, the arrester arrangement comprises a common mounting plate, and wherein each of the plurality of surge arresters is mounted and electrically connected with one of the first electrode and the second electrode to the common mounting plate. The mounting plate may e.g. be connected to ground or ground potential or to an arbitrary potential. Accordingly, the first electrodes or the second electrodes of the surge arresters may be connected to ground, or ground potential, or an arbitrary potential via the common mounting plate. Mounting the arresters on the common mounting plate may advantageously provide a compact and robust arrester arrangement with only little space requirements. Further, such arrangement may facilitate simple field installations, e.g. on a three-phase transformer system, short electrical connections, low impedances, longer protection distances and/or better protection levels. The arrester arrangement may also comprise a plurality of common mounting plates, for instance two, which may be connected to the first or second electrodes of the surge arresters.

According to a further embodiment of the invention, the arrester arrangement comprises a further arrester, wherein each of the plurality of surge arresters is connected to ground with one of the first and the second electrode via the further arrester. The further arrester may refer to a common arrester for the arrester arrangement, which further arrester may increase a protection of electrical equipment against over-voltage transients. The plurality of surge arresters may e.g. be directly connected to the further arrester or they may be connected to and/or mounted to a common mounting plate, which mounting plate may be connected to ground via the further arrester.

According to a further embodiment of the invention, at least three of the plurality of surge arresters and/or a further arrester are molded in a monolithic block of insulating material. Each of the plurality of surge arresters may be connected to ground with one of the first and the second electrode via the further arrester. Further, each of the surge arresters may be connected to a common mounting plate, which may optionally be connected to ground via the further arrester. Also the common mounting plate may be molded in the monolithic block. This way, a compact, robust and weatherproof monolithic arrester arrangement may be provided, which may allow simple, easy and quick installation.

These and other aspects of the invention will be apparent from and elucidated with reference to the embodiments described hereinafter.

BRIEF DESCRIPTION OF THE DRAWINGS

The subject-matter of the invention will be explained in more detail in the following text with reference to exemplary embodiments which are illustrated in the attached drawings.

The reference symbols used in the drawings, and their meanings, are listed in summary form in the list of reference symbols. In principal, identical parts are provided with the same reference symbols in the figures.

DETAILED DESCRIPTION OF THE INVENTION

Figure 1:
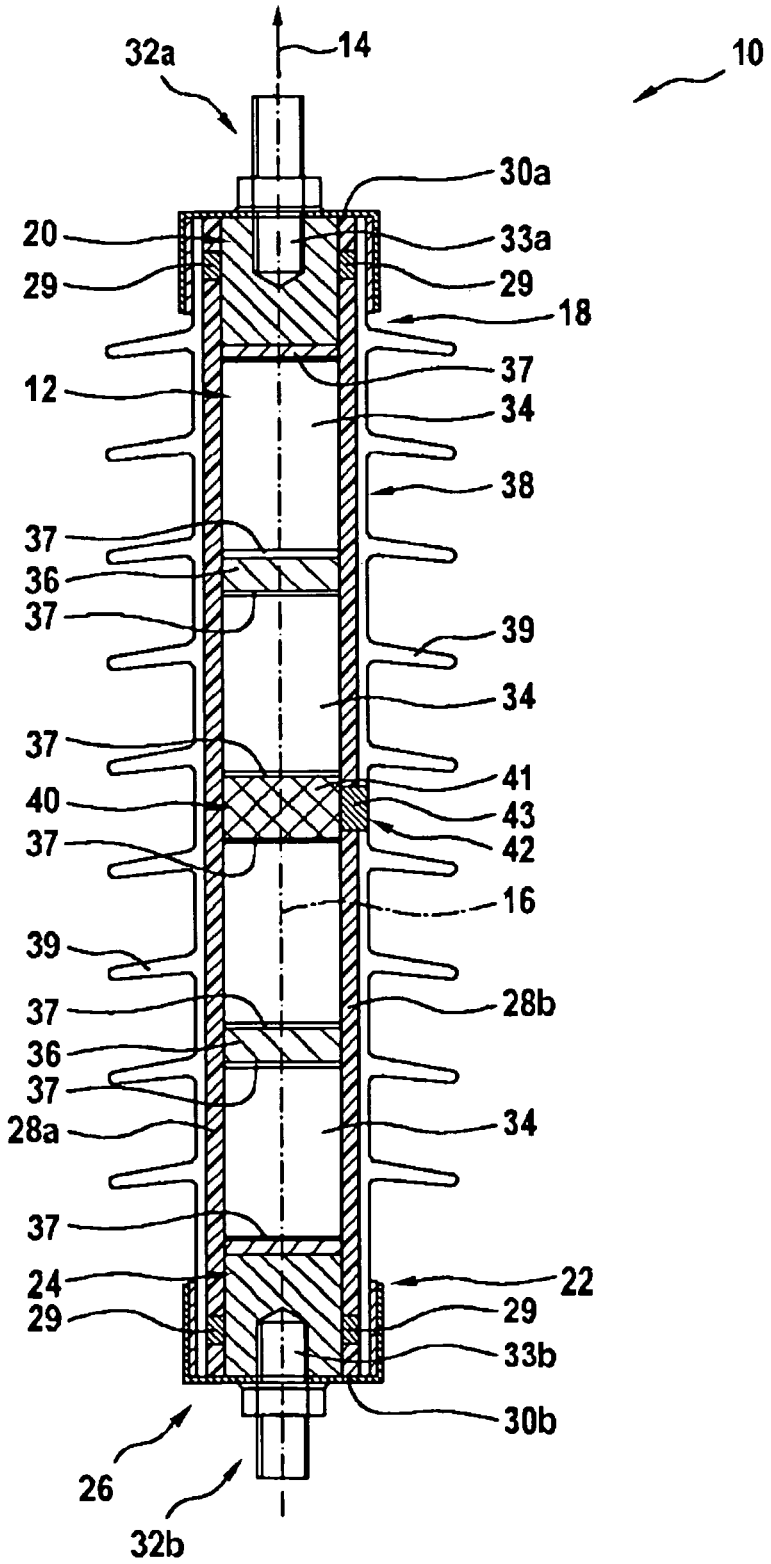
FIG. 1 shows a longitudinal section of a multi-terminal surge arrester according to an embodiment of the invention.

FIG. 1 shows a longitudinal section of a multi-terminal surge arrester 10 according to an embodiment of the invention.

The surge arrester 10 comprises an active part 12, which extends along a longitudinal direction 14 of the surge arrester 10. The active part 12 is substantially cylindrically shaped and arranged coaxially to a longitudinal axis 16 of the surge arrester 10. The longitudinal axis 16 may denote a center axis and/or a cylinder axis of the surge arrester 10.

The surge arrester 10 further comprises a first electrode 20, which rests against and is in contact with a first end 18 of the active part 12. A second electrode 24 rests against and is in contact with a second end 22 of the active part 12, which second end 22 opposes the first end 18 in the longitudinal direction 14. Accordingly, the first electrode 20 and the second electrode 24 are spaced apart from one another along the longitudinal axis 16. Both the first electrode 20 and the second electrode 24 may be formed as disk-like and/or substantially circular cylindrical blocks of electrically conductive material, such as for example aluminum or any other appropriate metal or alloy. The first and the second electrodes 20, 24 may denote electrical terminals and or electrical taps, respectively.

The surge arrester 10 further comprises an insulating fixing device 26, which mechanically connects and clamps the first electrode 20 and the second electrode 24 as well as mechanically fixes the active part 12. For this purpose, the fixing device 26 comprises a first fixing element 28*a* and a second fixing element 28*b*, which first and second fixing elements 28*a*, 28*b* are arranged parallel to the longitudinal axis 16 of the surge arrester 10 laterally on opposing sides of the active part 12. The first and the second fixing elements 28*a*, 28*b* may be in direct contact with the active part 12 and they may be manufactured from insulating material. For example the first and the second fixing elements 28*a*, 28*b* may be manufactured from a wound, glass fiber reinforced tape embedded in a plastic matrix. For the fixing elements 28*a*, 28*b* various embodiments are conceivable. By way of example, the fixing elements 28*a*, 28*b* may be formed as strap, strip, sheet, plate, tube, loop, rod, and/or bar mechanically connecting the first electrode 20 and the second electrode 24. The fixing elements 28*a*, 28*b* are each connected with a first end to the first electrode 20 and with a second end opposing the first end in longitudinal direction 14 to the second electrode 24 by appropriate mechanical fixing means 29, such that the first electrode 20 is fixed in a position pressing against the first end 18 of the active part 12 and such that the second electrode 24 is fixed in a position pressing against the second end 22 of the active part 12. For instance the fixing means 29 may comprise a bolt element, a screw element, and/or a rivet element, which may be arranged orthogonal to the longitudinal direction 14. The fixing elements 28*a*, 28*b* may additionally or alternatively be glued, soldered, and/or welded to the first electrode and second electrode 24.

However, the fixing device 26 may alternatively or additionally to the fixing elements 28*a*, 28*b* comprise e.g. a substantially circular cylindrical tube and/or a hose arranged coaxially to the longitudinal axis 16, in which tube and/or hose the active part 12 may be arranged and mechanically fixed. In other words, the fixing device 26 may comprise a tube and/or hose at least partly encompassing the active part 12 and thereby mechanically fixing it.

For further fixation and/or protection of the first and second electrodes 20, 24, the fixing device 26 comprises a first end cap 30*a* at least partially encompassing the first electrode 20 and a second end cap 30*b* at least partially encompassing the second electrode 24. The first end cap 30*a* is attached to the first electrode 20 and the second end cap 30*b* is attached to the second electrode 24 by an attachment element 32*a*, 32*b*, respectively. The attachment elements 32*a*, 32*b* may for instance be a bolt, a rivet, or a screw arranged along the longitudinal direction 14 and at least partially engaging a correspondingly formed cavity 33*a*, 33*b* or recess of the first and second electrode 20, 24. Accordingly, the cavities 33*a*, 33*b* may comprise a thread, in which the attachment elements 32*a*, 32*b* may be screwed. Alternatively or additionally the attachment elements 32*a*, 32*b* may be held in the cavities 33*a*, 33*b* by form fit and/or friction fit. It is noted here that in various other embodiments of the invention, the end caps 30*a*, 30*b* may not be provided. Thus, the end caps 30*a*, 30*b* may generally be considered optional.

The active part 12 of the surge arrester 10 comprises a plurality of varistor elements 34. The varistor elements 34 may be disk-like and/or substantially circular cylindrically shaped blocks of metal-oxide based material, e.g. ZnO based material. Therein, each varistor element 34 may comprise a plurality of disk-like and/or substantially circular cylindrical varistor sub-elements stacked on top of each other in longitudinal direction 14 to form a single varistor element 34. The varistor elements 34 are arranged coaxially to the longitudinal axis 16 of the surge arrester 34 in a stack along the longitudinal direction 14. In order to ensure proper electrical and/or thermal contact between the varistor elements 34 and parts/elements of the surge arrester 10 adjoining the varistor elements 34 in axial direction 14, the varistor elements 34 may further comprise a conductive layer on at least one abutting face and/or abutting side. The at least one abutting face may denote an outer surface of the varistor element 34 having a surface normal vector directed parallel or antiparallel to the longitudinal direction 14. The conductive layer may e.g. be an aluminum film sprayed on the respective surface and/or any other appropriate metallization. Further, a circumferential and/or peripheral surface of the varistor elements 34 may be passivated by appropriate passivation means and/or an appropriate passivation layer.

The active part 12 further comprises a plurality of metal-spacers 36, which may be formed as disk-like and/or substantially circular cylindrical metal sheets and/or metal blocks. The metal-spacers 36 may also comprise a middle portion having a smaller circumference than a circumference of an end portion of the metal-spacers 36. The metal-spacers 36 may e.g. be manufactured from aluminum, metal, and/or an alloy. Each metal-spacer 36 is arranged between two in longitudinal direction 14 neighboring varistor elements 34. It is noted here that in various other embodiments of the invention, the metal-spacers 36 may not be provided. Thus, the metal-spacers 36 may generally be considered optional.

In order to ensure proper electrical and/or thermal contact between the metal-spacers 36 and the varistor elements 34, an electrically and/or thermally conductive metal sheet 37 is arranged between each side of a metal-spacer 36 facing and/or abutting a side of a varistor element 34. The metal sheets 37 may e.g. comprise an aluminum sheet and/or they may be manufactured from aluminum. The arrangement of a metal-spacer 36 between two metal sheets 37 and two in longitudinal direction 14 consecutively arranged varistor elements 34, ensures that an over-voltage transient may be reliably conducted between the two consecutive varistor elements 34 via the metal sheets 37 and the metal-spacer 36. Thereby, a continuous conduction path between the two consecutive varistor elements 34 may be provided. Apart from an electrical connection between two consecutive varistor elements 34, the metal-spacers 36 may dissipate, conduct, and/or spread any heat generated by the over-voltage transient, wherein heat may be spread axially and/or radially, i.e. orthogonal to the longitudinal direction 14. This may reduce thermal material stress caused by the over-voltage transient and the generated heat. It is noted here that in various other embodiments of the invention, the metal sheets 37 may not be provided. Thus, the metal sheets 37 may generally be considered optional.

Also between the first electrode 20 and the respective varistor element 34 abutting the first electrode 20 as well as between the second electrode 24 and the respective varistor element 34 abutting the second electrode 24 a metal sheet 37 as described in the above may be arranged in order to ensure proper electrical and/or thermal contact.

The surge arrester 10 further comprises an insulating housing 38, which is molded around the active part 12, at least partially around the fixing device 26 and/or at least partially around the first and second electrodes 20, 24. Accordingly, the insulating housing 38 encompasses, encloses and/or surrounds the active part 12, at least partially the fixing device 26, and/or at least partially the first and second electrodes 20, 24 along an outer circumference of the respective parts and/or elements 12, 26, 20, 24 of the surge arrester 10 in order to provide a water-proof cover and/or protection for these elements. To avoid air inclusions and/or air entrapments as well as to ensure proper adhesion of the insulating housing 38 at the active part 12, the fixing device 26, and/or the first and second electrodes 20, 24, a layer of adhesion promoting material, such as e.g. an adhesion-promoting agent, a bonding agent and/or a primer, may be arranged between the insulating housing 38 and the respective parts and/or elements 12, 26, 20, 24 of the surge arrester 10.

The insulating housing 38 may for instance be manufactured from a solid insulating material and/or a solid state insulating material, such as e.g. silicone, and/or it may be injection-molded and/or casted and/or extruded. However, various other materials for the insulating housing 38 may be conceivable, such as for instance a thermoplast (e.g. polyethylene), plastic material, resin-based curing material, or an elastomer, such as e.g. ethylene propylene terpolymer and/or a thermoplastic elastomer. Particularly for an outdoor installation of the surge arrester 10, the insulating housing 38 may optionally comprise a plurality of sheds 39 or creep distance extenders, which may be integrally formed with the insulating housing 38, and which are formed as umbrella-like projections surrounding the insulating housing 38 along an outer circumference thereof.

The surge arrester 10 further comprises a further electrode 40 arranged and/or held between two in longitudinal direction 14 consecutively arranged and/or neighboring varistor elements 34 of the active part 12. The further electrode 40 may be disk-like and/or substantially circular cylindrically formed, arranged coaxially to the longitudinal axis 16, and it may be manufactured from electrical conductive material, such as e.g. metal, aluminum and/or an appropriate alloy. Between each side of the further electrode 40 abutting and/or adjoining a side of a varistor element 34, a metal sheet 37 may be arranged to enhance an electrical and/or thermal contact between the varistor elements 34 and the further electrode 40.

The further electrode 40 provides an externally accessible electrical connection to the surge arrester 10, for instance for contacting and/or connecting a part of a transformer, such as e.g. a winding, an end tap or an intermediate tap of the transformer, to a mid-point of the surge arrester 10, wherein the mid-point may denote an arbitrary point, location, position and/or region of the surge arrester 10 between the first and second electrodes 20, 24. For this purpose, the further electrode 40 shown in FIG. 1 comprises a protrusion 42, which extends from a disk-like and/or circular cylindrical body region 41 of the further electrode 40 orthogonal to the longitudinal direction 14 of the surge arrester 10. The body region 41 may refer to a middle or center region of the further electrode 40. The protrusion 42 may at least partially extend through the fixing device 26 and/or the insulating housing 38, thereby providing a tapping region 43, which may be electrically connected and/or contacted, for instance with an appropriate fastener, clip and/or clamp device, from an outside of the surge arrester 10. The protrusion 42 may for example protrude through an opening in the fixing device 26 or it may be arranged next to the fixing device 26 along a circumference of the active part 12.

Generally, the protrusion 42 protrudes nose-like orthogonal to the longitudinal direction 14 from the body region 41 of the further electrode 40. A thickness of the protrusion 42, an extension of the protrusion 42 in longitudinal direction 14, may be equal, smaller or larger than a thickness of the body region 41, i.e. an extension of the body region 41 in longitudinal direction 14. The protrusion 42 may be arbitrarily shaped, such as e.g. box-like, cylindrical, and/or trapezoidal. Further, the protrusion 42 may be integrally formed with the further electrode 40 or it may be formed as a separate part, which may be attached to the further electrode 40, e.g. by mechanical fixation, by gluing, welding and/or soldering.

Figure 2:
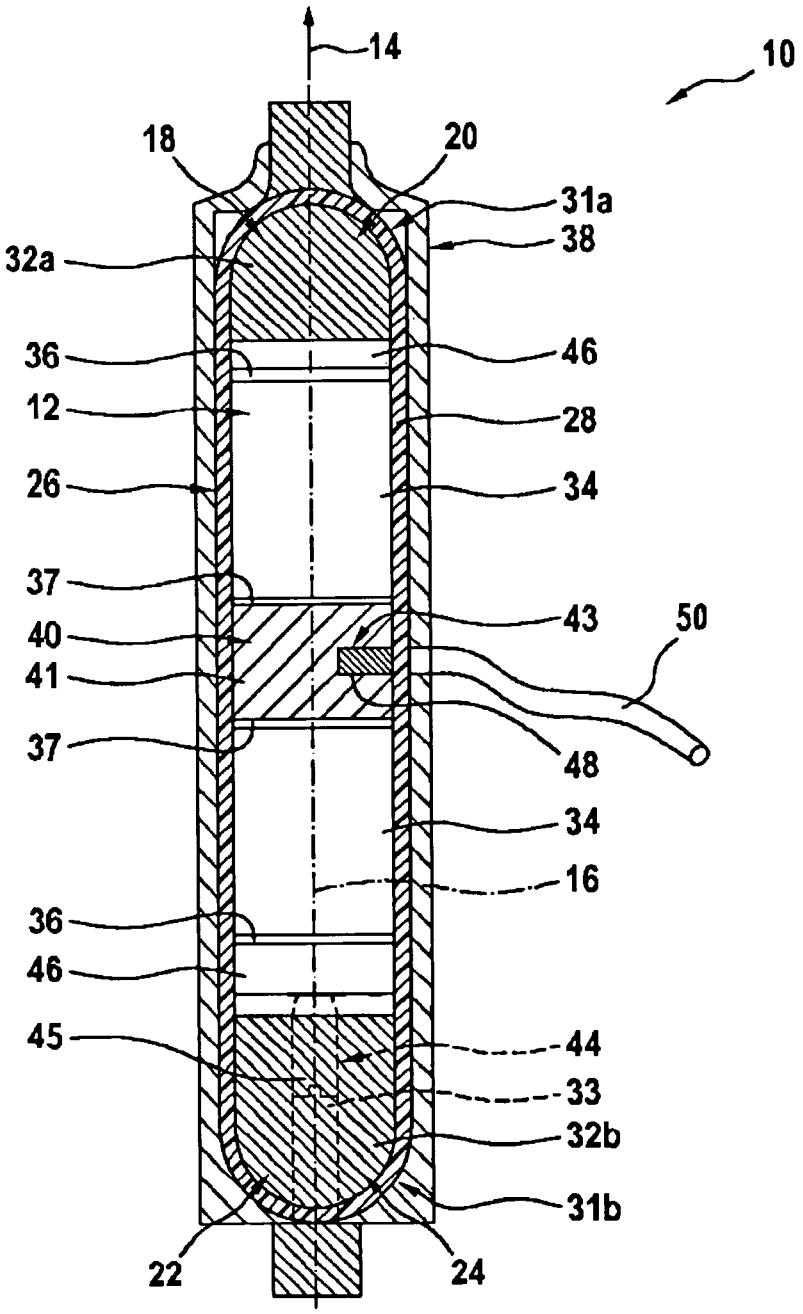
FIG. 2 shows a longitudinal section of a multi-terminal surge arrester according to another embodiment of the invention.

FIG. 2 shows a longitudinal section of a multi-terminal surge arrester 10 according to another embodiment of the invention. If not stated otherwise, the surge arrester 10 of FIG. 2 may comprise the same elements and features as the surge arrester 10 of FIG. 1.

The surge arrester 10 comprises a fixing device 26 with a loop 28 as fixing element, which may be manufactured e.g. from wrapped, glass fibers in a plastic matrix. The fixing device 26 may comprise a plurality of loops 28, which may be arranged along an outer circumference of the active part 12. The loop 28 may comprise a first semicircular end 31*a*, which rests against a shoulder 32*a* having a semicircular outer surface formed cooperative to the first semicircular end 31*a*. The loop 28 further comprises a second semicircular end 31*b*, which opposes the first semicircular end 31*a* in longitudinal direction 14 and which rests against a further shoulder 32*b* having a semicircular outer surface formed cooperative to the second semicircular end 31*b*. The shoulders 32*a*, 32*b* project and/or extend from the first end 18 and second end 22 of the active part 12, respectively, to facilitate an application and/or mounting of the loop 28. It is noted here, that the ends 31*a*, 31*b* may not necessarily be shaped semicircular. They may rather be arbitrarily shaped, such as e.g. rectangular or triangular. Further, the shoulders 32*a*, 32*b* may generally be considered as supporting means adapted for mechanically supporting the loop 28. Thus, also the shoulders 32*a*, 32*b* may be arbitrarily shaped.

The surge arrester 10 further comprises a hole and/or bore 35 aligned coaxially with the longitudinal axis 16, in which a clamping bolt 45 may be displaceably guided along the longitudinal direction 14.

The surge arrester 10 comprises at least one disk-like and/or substantially circular cylindrically shaped pressure plate 46 arranged in the active part 12 adjacent to the first electrode 20 and/or adjacent to the second electrode 24, respectively. The pressure plates 46 may for instance be manufactured from aluminum providing a certain elasticity and/or deformability.

The surge arrester 10 of FIG. 2 comprises a further electrode 40 providing an externally accessible electrical mid-point connection to the surge arrester 10. To provide a tapping region 43, the further electrode 40 comprises a hole 48 at least partially extending into a body region 41 of the further electrode 40. The hole 48 may extend in arbitrary direction into the body region 41. Preferably, the hole 48 extends orthogonal to the longitudinal direction 14 into the body region 41. Further, the hole 48 may denote e.g. a recess and/or a bore formed in the body region 41 extending partially or entirely through the body region 41. In the hole 48 an end of an electrical connection cable 50 is positioned in order to allow establishment of an electrical connection to the further electrode 40, for instance with a tap of a transformer. The cable 50 is conducted through the insulating housing 38 of the surge arrester 10, wherein the insulating housing 38 may engage and/or encompass and/or surround the cable 50 along an outer circumference thereof in order to avoid humidity, water, and/or dirt from entering the surge arrester 10. For attachment purposes, the hole 48 may comprise a thread, in which a correspondingly threaded connection element attached to the end of the cable 50 may be screwed. However, the cable 50 may also be tightly clamped and/or plugged into the hole 48 by form-fit and/or friction fit. The cable 50 may also be welded to the further electrode 40 and/or attached to the further electrode 40 with a rivet element locking the cable 50 in the hole 48. Further, the cable 50 may be e.g. shot through the housing 38 into the further electrode 40 after molding the insulating housing 38 around the active part 12, the fixing device 26 and/or the first and second electrodes 20, 24.

Figure 3A:
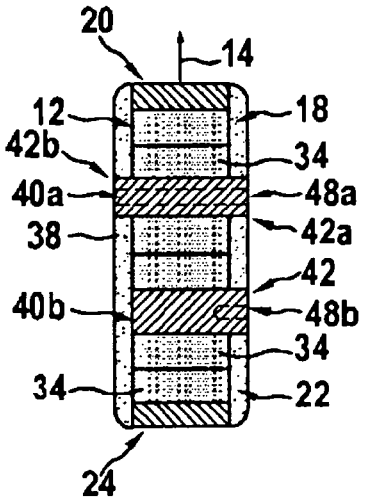
FIG. 3A shows a longitudinal section of a multi-terminal surge arrester according to a further embodiment of the invention.

FIG. 3A shows a longitudinal section of a multi-terminal surge arrester 10 according to a further embodiment of the invention. If not stated otherwise, the surge arrester 10 of FIG. 3A may comprise the same elements and features as the surge arresters 10 of FIGS. 1 and 2.

Figure 3B:
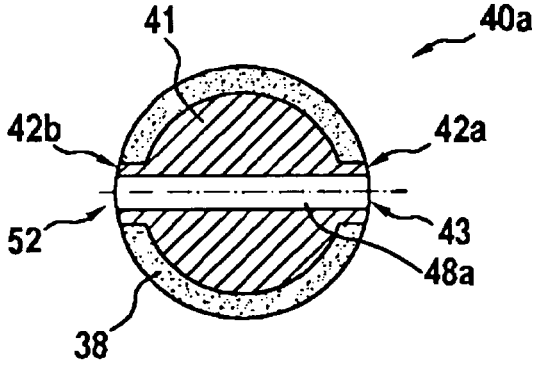
FIGS. 3B and 3C each show a cross-section through a further electrode of the multi-terminal surge arrester of FIG. 3A.
Figure 3C:
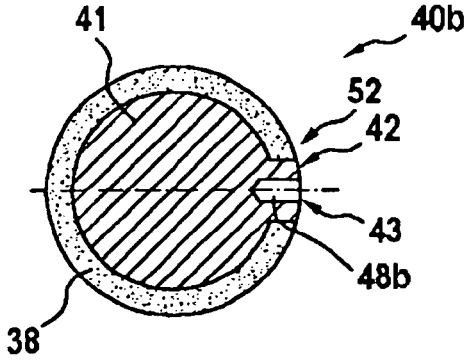

The surge arrester 10 of FIG. 3A comprises a first further electrode 40*a* and a second further electrode 40*b*, each arranged between two adjacent varistor elements 34 in a stack arrangement. A cross-sectional view of the first further electrode 40*a* is shown in FIG. 3B and cross-sectional view of the second further electrode 40*b* is shown in FIG. 3C.

The first further electrode 40*a* comprises two protrusions 42*a*, 42*b*, each extending and/or protruding orthogonal to the longitudinal direction 14 from a disk-like body region 41 of the electrode 40*a*. The two protrusions 42*a*, 42*b* are arranged on opposing sides of the body region 41. However, the protrusions 42*a*, 42*b* may be arranged in an arbitrary angle with respect to each other.

Each of the protrusions 42*a*, 42*b* extends entirely through the insulating housing 38, wherein an outer surface of each protrusion 42*a*, 42*b* is flush with an outer surface of the insulating housing 38. The protrusions 42*a*, 42*b* may alternatively protrude beyond the outer surface of the insulating housing 38 or they may only partly extend through the insulating housing 38.

The first further electrode 40*a* further comprises a hole 48*a* extending orthogonal to the longitudinal direction 14 entirely through the electrode 40*a* and the two protrusions 42*a*, 42*b*. The hole 48*a* may extend through an arbitrary region of the body region 41, preferably through a center region. The hole 48*a* may have a diameter of at least 1 mm, for example at least 3 mm, and preferably at least 4 mm.

Further the hole 48*a* may comprise a thread, which may be formed in at least a part of at least one of the two protrusions 42*a*, 42*b*, thereby providing a tapping region 43 for electrical connection and/or a fixation region 52 for mechanically fixing and/or mounting the surge arrester 10 e.g. to a transformer. In other words, one of the protrusions 42*a* may provide an externally accessible electrical connection, wherein e.g. a connection cable may be screwed, clamped and/or attached to the hole 48*a* formed in the protrusion 42*a*, whereas the other protrusion 42*b* may serve for mounting the surge arrester 10 to some other device using appropriate mechanical attachment means, such as e.g. a screw, a bolt, and/or a rivet. By way of example, a single bolt element and/or a screw arranged in and/or extending through the hole 48*a* may be utilized to provide the externally accessible electrical connection on at least one of the protrusions 42*a*, 42*b*, e.g. by fixing and/or contacting a cable to the further electrode 40, while simultaneously providing a mechanical fixation of the surge arrester 10 at the other protrusion 42*a*, 42*b*. Between the protrusion 42*a*, 42*b* used for mechanical fixation and a further device, to which the surge arrester 10 may be mounted to (e.g. a transformer and/or a transformer housing), a spacer may optionally be arranged, which spacer may be mechanically fixed by the single bolt element and/or the screw extending through the hole 48*a*. However, also a plurality of bolt elements and/or screws may be used, which may not necessarily extend entirely through the hole 48*a*.

The second further electrode 40*b* comprises a protrusion 42 extending and/or protruding orthogonal to the longitudinal direction 14 from a disk-like body region 41 of the electrode 40*b*. The protrusion 42 extends entirely through the insulating housing 38, wherein an outer surface of the protrusion 42 is flush with an outer surface of the insulating housing 38. The protrusion 42 may alternatively protrude beyond the outer surface of the insulating housing 38 or it may only partly extend through the insulating housing 38.

The second further electrode 40*b* further comprises a hole 48*b* extending orthogonal to the longitudinal direction 14 only partly through the electrode 40*b* and the protrusion 42. The hole 48*b* may have a diameter of at least 2 mm, for example at least 3 mm, and preferably at least 4 mm.

Further the hole 48*b* may comprise a thread, which may be formed in at least a part of the protrusions 42, thereby providing a tapping region 43 for an electrical connection. However, additionally or alternatively the second further electrode 40*b* with protrusion 42 and hole 48*b* may also provide a fixation region 52 for mechanically fixing and/or mounting the surge arrester 10 e.g. to a transformer.

The first further electrode 40*a* and its hole 48*a* may have an arbitrary orientation with respect to the second further electrode 40*b* and its hole 48*b*. In other words, the hole 48*a* may be arranged parallel to the hole 48*b* or in an arbitrary angle.

The surge arrester 10 of FIG. 3A may be mounted and/or fixed e.g. via a bolt, screw, and/or rivet and/or any other appropriate fixation means with its first further electrode 40*a* and one of the protrusions 42*b*, 42*a* e.g. directly to a transformer. Furthermore, the second further electrode 40*b* may provide a further tapping region 43 for electrical connection and/or a further fixation region 52 for mounting and/or attaching the arrester 10 e.g. to the transformer. Generally, an orientation of the first further electrode 40*a* and/or the hole 48*a* may differ from an orientation of the second further electrode and/or the hole 48*b* to allow short connection leads e.g. to a transformer, which short connection leads may improve over-voltage protection.

However, the surge arrester 10 may also comprise more than two further electrodes 40*a*, 40*b*.

Figure 4A:
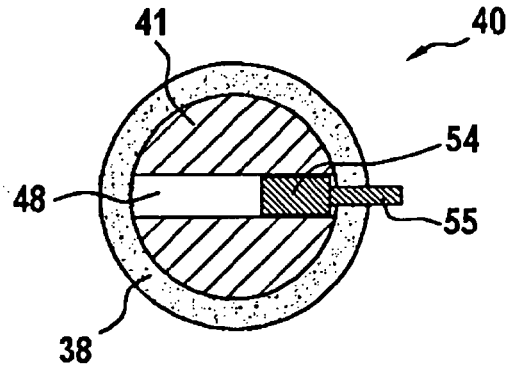
FIGS. 4A and 4B each show a further electrode for a surge arrester according to an embodiment of the invention illustrating steps of a production process thereof.
Figure 4B:
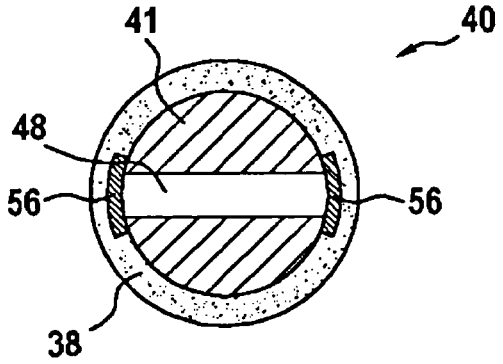

FIGS. 4A and 4B each show a further electrode 40 for a surge arrester 10 according to an embodiment of the invention, illustrating steps of a production process of the further electrodes 40. If not stated otherwise, the further electrodes 40 shown in FIGS. 4A and 4B may comprise the same elements and features as the further electrodes 40, 40*a*, 40*b* of FIGS. 1 to 3C.

During a production of a surge arrester 10, the varistor elements 34, the metal-spacers 36 and at least one further electrode 40 are stacked to form the active part 12. The active part as well as the first and second electrodes 20, 24 are then mechanically fixed with the fixation device 26 and the insulating housing 38 is molded.

The holes 48 of each of the further electrodes 40 may be formed and/or drilled before or after the molding process. If the holes 48 are drilled before molding, means for accessing the further electrode 40 and/or the hole 48 and/or means for preventing housing material from entering the hole 48 may be utilized in order to avoid interference with the molding process and/or interference with the potentially radially recessed tapping region 43. For this purpose, e.g. a plug 54 can be inserted at least partially into the hole 48 before molding, a region of the insulating housing 38 being formed around the hole 48 may be removed using appropriate tools after molding, and finally the plug 54 can be removed e.g. using a clamping aid 55, such as a screw. Alternatively or additionally a separation tape 56 may be used to cover the hole before molding. The tape 56 can easily be removed after molding, thereby allowing easy removal of housing material covering the hole 48.

Figure 5:
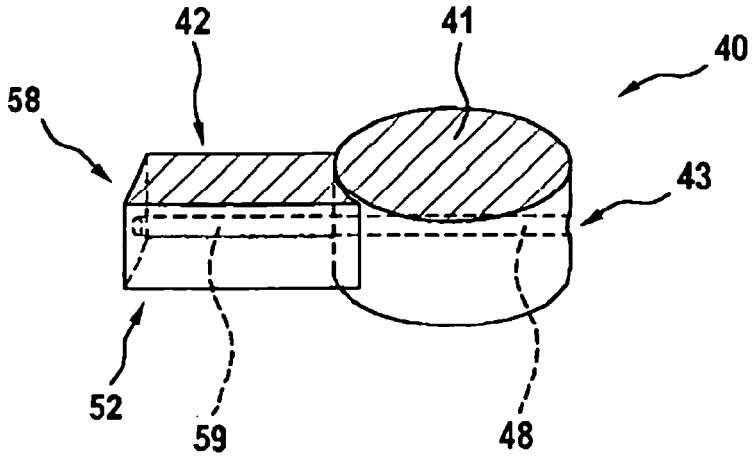
FIG. 5 shows a further electrode for a surge arrester according to an embodiment of the invention.

FIG. 5 shows a further electrode 40 for a surge arrester 10 according to an embodiment of the invention. If not stated otherwise, the further electrode 40 of FIG. 5 may comprise the same elements and features as the further electrodes 40, 40*a-b* shown in FIGS. 1 to 4B.

On a side of the further electrode 40 providing the fixation region 52 and opposing the side of the electrode 40 providing the tapping region 43, a spacer 58 is arranged for geometrical separation and/or insulation purposes. The spacer 58 may be integrally formed with the further electrode 40 or it may be formed as separate part and attached to the further electrode 40, e.g. by gluing, welding, soldering, and/or mechanically, e.g. by a screw, a bolt, and/or a rivet. Also a plurality of spacers 58 may be attached to the further electrode 40. The spacer 58 may comprise a spacer hole 59 leading into the hole 48 of the further electrode 40. The spacer hole 59 may accordingly be flush with the hole 48 of the further electrode 40.

Figure 6:
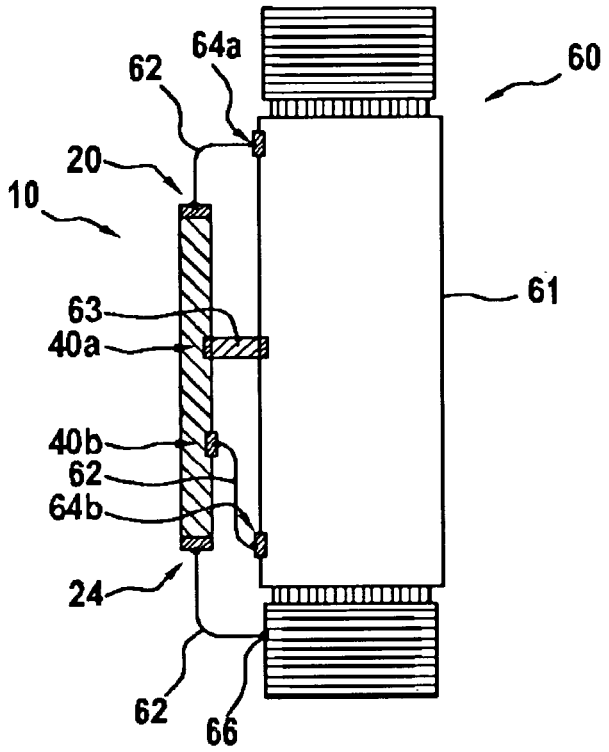
FIG. 6 shows a surge arrester according to an embodiment of the invention mounted to a transformer.

FIG. 6 shows a surge arrester 10 according to an embodiment of the invention mounted to a transformer 60. If not stated otherwise, the surge arrester 10 of FIG. 6 may comprise the same features and elements as the surge arresters 10 of FIGS. 1 to 5.

A first electrode 20 of the surge arrester 10 is connected to a first transformer end tap 64*a* via an electrical connection element 62, which may e.g. be an electrical wire, a conductive rod and/or a cable. A second electrode 24 of the surge arrester 10 is connected to a ground 66 via a further electrical connection element 62.

Via a first further electrode 40*a* of the surge arrester 10 the surge arrester 10 is mechanically fixed on a transformer housing 61 via an appropriate mechanical fixation means 63, which may e.g. be a plate or bar protruding from the transformer housing 61 and which may be fixed to the first further electrode 40*a*, e.g. using a bolt, a rivet and/or a screw engaging at least partly into a hole 48 of the first further electrode 40*a*.

A second further electrode 40*b* of the surge arrester 10 is connected via a further connection element 62 to a second transformer end tap 64*b*.

FIGS. 7A to 7F each show an arrester arrangement 68 according to an embodiment of the invention. Each arrester arrangement 68 comprises three multi-terminal surge arresters 10*a*, 10*b*, 10*c* arranged in juxtaposition in a row next to each other. The arrester arrangements 68 may for instance be connected to a three-phase transformer. Other arrangements may be used as well, e.g. in a triangular way for a triangular core transformer.

Figure 7A:
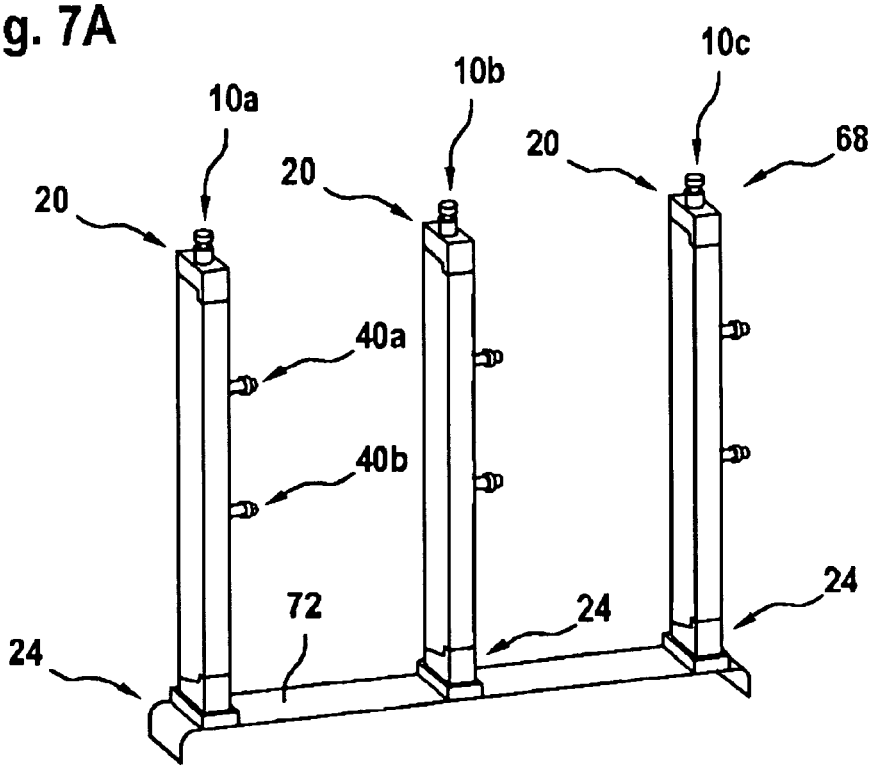
FIGS. 7A to 7F each show an arrester arrangement according to an embodiment of the invention.
Figure 7B:
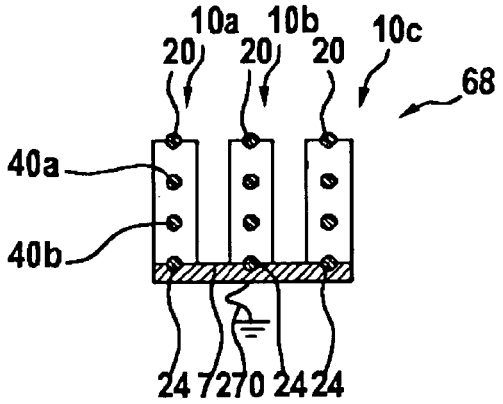
Figure 7C:
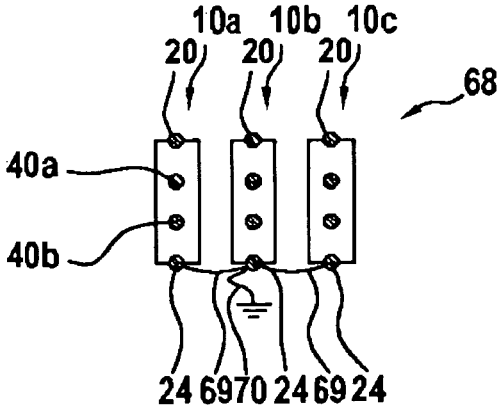
Figure 7D:
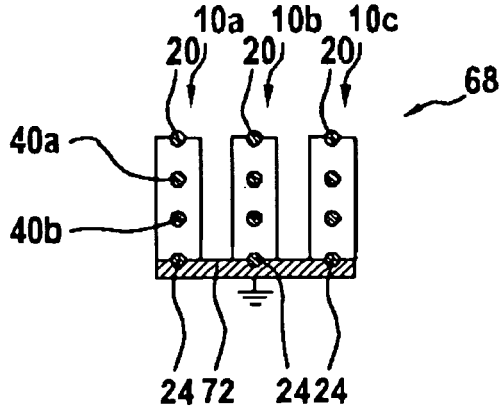
Figure 7E:
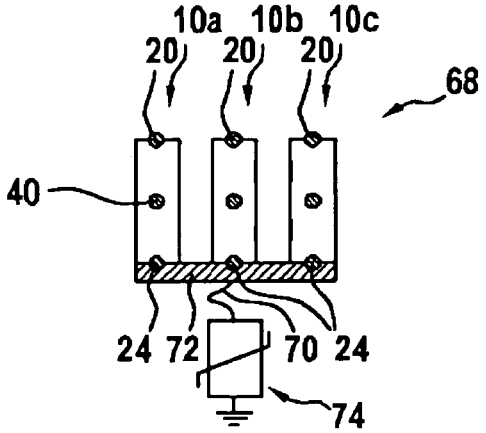
Figure 7F:
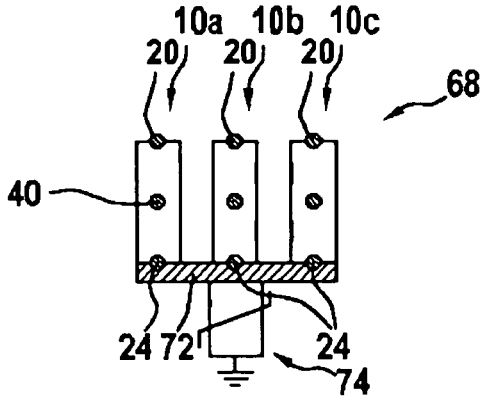

The surge arresters 10*a-c* of the arrester arrangements 68 of FIGS. 7A to 7D comprise in total four terminals each, i.e. a first electrode 20, a second electrode 24, a first further electrode 40*a*, and a second further electrode, whereas the surge arresters 10*a-c* of the arrester arrangements 68 of FIGS. 7E and 7F comprise in total three terminals each, i.e. a first electrode 20, a second electrode 24 and a further electrode 40. The terminals may be attached e.g. to a coil, a yoke, a frame, and/or a housing 61 of a transformer 60.

The first electrode 20 of each surge arrester 10*a-c* may be attached to a transformer end tap 64*a*, 64*b*, and the second electrode 24 may be connected to a ground or ground potential. For this purpose, each second electrode 24 may be separately connected to ground, e.g. with a cable, or the second electrodes 24 of an arrester arrangement 68 may be interconnected with a cable to a common ground cable 70, which in turn is connected to ground.

Alternatively, each surge arrester 10*a-c* can be mounted with the second electrode 24 to a common electrically conductive mounting plate 72, wherein the mounting plate 72 may be directly connected to ground (FIG. 7D) or via a ground cable 70 (FIG. 7B). Apart from that, the mounting plate 72 can be connected to an arrester 74 via a cable 70 as shown in FIG. 7E or directly as shown in FIG. 7F, wherein the arrester 74 is in turn connected to ground.

Further, the further electrode 40 of the surge arresters 10*a-c* comprising in total three terminals as shown in FIGS. 7E and 7F, as well as the first and second further electrodes 40*a*, 40*b* of the four terminal surge arresters 10*a-c* shown in FIGS. 7A to 7D, can be electrically connected to a tap of the transformer 60 and/or used for mechanically fixing and/or mounting the respective surge arresters 10*a-c* of the arrester arrangement 68 e.g. on a housing 61 of the transformer 60.

Figure 8A:
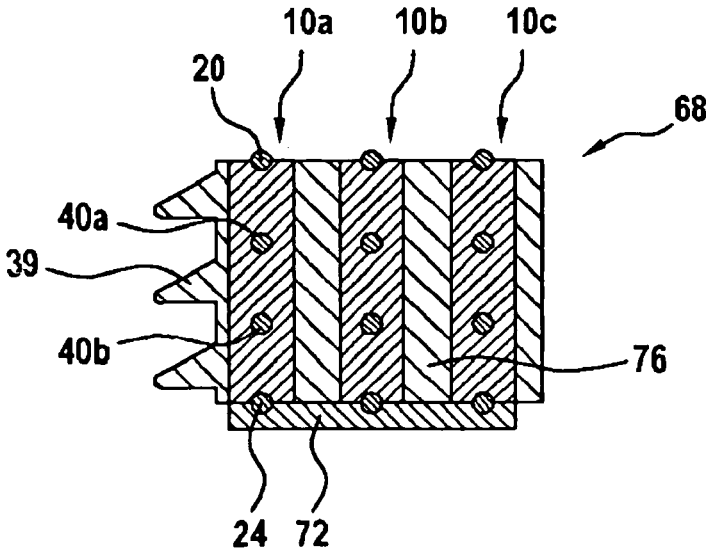
FIGS. 8A to 8D each show an arrester arrangement according to an embodiment of the invention.
Figure 8B:
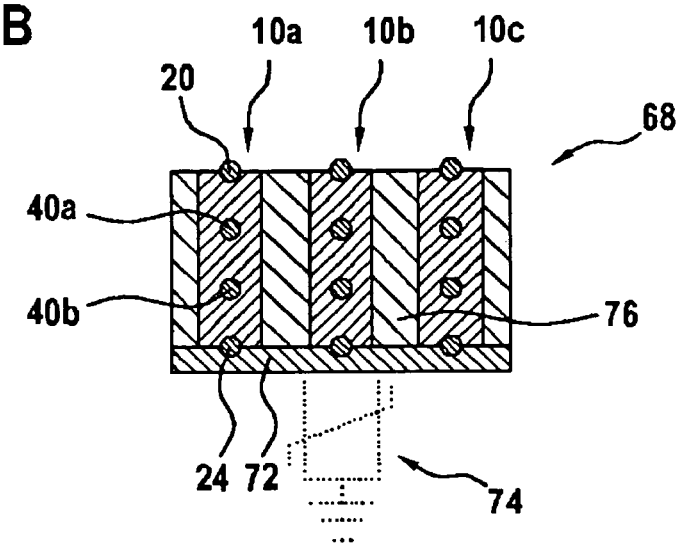
Figure 8C:
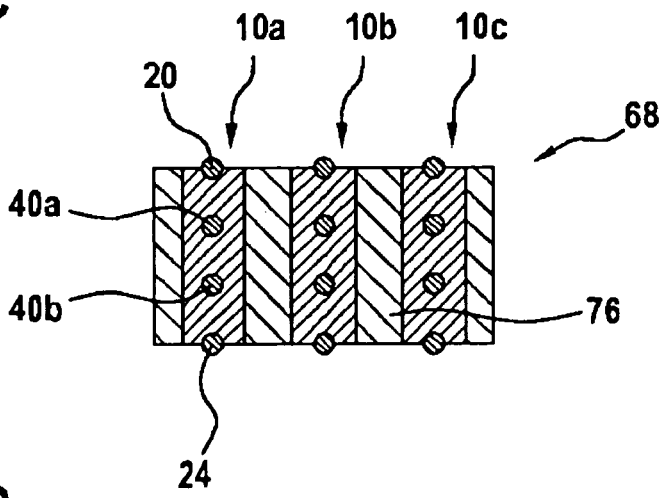
Figure 8D:
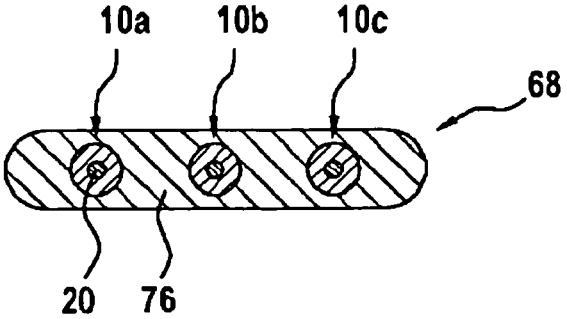

FIGS. 8A to 8D each show an arrester arrangement 68 according to an embodiment of the invention, wherein FIGS. 8A to 8C show a side view and FIG. 8D shows a top view.

Each of the arrester arrangements 68 shown in FIGS. 8A to 8D comprise three surge arresters 10*a-c* arranged in juxtaposition in a row. The surge arresters 10*a-c* may comprise in total three or four terminals and they may be mounted on and/or connected to a common mounting plate 72 as described in FIGS. 7A to 7F.

The surge arresters 10*a-c* of the arrester arrangements 68 are molded in a monolithic block 76 of insulating material, such as e.g. silicon-based material, a (thermoplastic) elastomer, a thermoplast such as polyethylene, a resin based cured material or plastic material. Therein, sheds 39 may be integrally formed as creep distance extenders or are omitted if not needed, e.g. for indoor applications, as illustrated and/or indicated on the right-hand side of the arrester arrangement 68 shown in FIG. 8A. Also the common mounting plate 72 may be at least partially molded in the immolithic block.

While the invention has been illustrated and described in detail in the drawings and the foregoing description, such illustration and description are to be considered illustrative or exemplary and not restrictive; the invention is not limited to the disclosed embodiments. Other variations to the disclosed embodiments can be understood and effected by those skilled in the art and practicing the claimed invention, from a study of the drawings, the disclosure, and the appended claims. In the claims, the word "comprising" does not exclude other elements or features, and the indefinite article "a" or "an" does not exclude a plurality. The mere fact that certain measures are recited in mutually different dependent claims does not indicate that a combination of these measures cannot be used to advantage. Any reference signs in the claims are not to be construed to as limiting the scope.

The invention claimed is:

1. A multi-terminal surge arrester, comprising:

an active part extending along a longitudinal direction of the surge arrester;

a first electrode resting against a first end of the active part;

a second electrode resting against a second end of the active part, the second end opposing the first end in the longitudinal direction of the surge arrester;

an insulating fixing device mechanically connecting and fixing the first electrode and the second electrode; and an insulating housing arranged around the active part, wherein the active part comprises at least two metal-oxide based varistor elements and a further electrode arranged between the at least two varistor elements, the further electrode providing an externally accessible electrical connection, wherein the surge arrester is adapted for being insulated by surrounding air, and wherein the further electrode provides a mid-point electrical connection that is accessible from outside the surge arrester, the mid-point electrical connection being configured to be electrically connected to a winding, an end tap or an intermediate tap of a transformer for protecting the transformer against medium to high over-voltage transients above approximately 1 kV.

2. The surge arrester according to claim 1, wherein the insulating housing comprises a solid insulation material.

3. The surge arrester according to claim 1, wherein the active part further comprises at least one metal-spacer for dissipating and/or conducting heat.

4. The surge arrester according to claim 1, wherein the further electrode comprises a hole adapted for providing a tapping region for electrical connection to the transformer and/or a fixation region for mechanical fixation to the transformer.

5. The surge arrester according to claim 1, wherein the further electrode comprises a protrusion extending orthogonal to the longitudinal direction of the surge arrester, and wherein the protrusion is adapted for providing a tapping region for electrical connection to the transformer and/or a fixation region for mechanical fixation to the transformer.

6. The surge arrester according to claim 1, wherein the further electrode extends through the insulating housing of the surge arrester, such that the further electrode is accessible from outside the housing.

7. The surge arrester according to claim 1, wherein the further electrode comprises a hole extending from an outer surface of the further electrode at least partially into a protrusion of the further electrode.

8. The surge arrester according to claim 1, wherein the further electrode comprises two protrusions, both extending orthogonal to the longitudinal direction.

9. The surge arrester according to claim 1, wherein the further electrode has a thickness of at least 5 mm.

10. The surge arrester according to claim 1, wherein the surge arrester comprises a plurality of varistor elements and at least two further electrodes, wherein each of the at least two further electrodes is arranged between two varistor elements, wherein each of the at least two further electrodes is adapted for providing an electrical connection to the transformer, and wherein at least one of the at least two further electrodes is adapted for providing a mechanical fixation of the surge arrester to the transformer in addition to the electrical connection.

11. The surge arrester according to claim 7, wherein the hole extends from the outer surface of the further electrode entirely through the further electrode.

12. The surge arrester according to claim 1, wherein the active part further comprises at least two metal sheets, a first metal sheet being disposed between the further electrode and one of the at least two varistor elements and a second metal sheet being disposed between the further electrode and another of the at least two varistor elements.

13. The surge arrester according to claim 1, wherein the further electrode extends through the insulating housing, such that the further electrode is accessible from outside the housing.

14. An arrester arrangement comprising:

a plurality of multi-terminal surge arresters, each surge arrester having:

an active part extending along a longitudinal direction of the surge arrester;

a first electrode resting against a first end of the active part;

a second electrode resting against a second end of the active part, the second end opposing the first end in the longitudinal direction of the surge arrester;

an insulating fixing device mechanically connecting and fixing the first electrode and the second electrode; and an insulating housing arranged around the active part, wherein the active part comprises at least two metal-oxide based varistor elements and a further electrode arranged between the at least two varistor elements, the further electrode providing an externally accessible electrical connection, wherein the further electrode provides a mid-point electrical connection that is accessible from outside the surge arrester, the mid-point electrical connection being configured to be electrically connected to a winding, an end tap or an intermediate tap of a transformer for protecting the transformer against medium to high over-voltage transients above approximately 1 kV, wherein each surge arrester is adapted for being insulated by surrounding air.

15. The arrester arrangement according to claim 14, wherein three surge arresters are arranged in juxtaposition in a row or in a triangular geometry.

16. The arrester arrangement according to claim 14, further comprising:

a common mounting plate, wherein each of the plurality of surge arresters is mounted and electrically connected with one of the first electrode and the second electrode to the common mounting plate.

17. The arrester arrangement according to claim 14, further comprising:

a further arrester, wherein each of the plurality of surge arresters is connected to ground with one of the first electrode and the second electrode via the further arrester.

18. The arrester arrangement according to claim 14, wherein at least three of the plurality of surge arresters and/or a further arrester are molded in a monolithic block of insulating material.

* * * * *